US006845847B2

(12) United States Patent
Nonaka et al.

(10) Patent No.: US 6,845,847 B2
(45) Date of Patent: Jan. 25, 2005

(54) LUBRICATION SYSTEM AND ITS MODIFICATION METHOD

(75) Inventors: Toshiaki Nonaka, Tokyo (JP); Masahiko Nakahara, Kanagawa-ken (JP); Yoshio Murakami, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 203 days.

(21) Appl. No.: 10/354,029

(22) Filed: Jan. 30, 2003

(65) Prior Publication Data

US 2003/0155183 A1 Aug. 21, 2003

(30) Foreign Application Priority Data

Jan. 31, 2002 (JP) ..... 2002-023905

(51) Int. Cl.[7] ..... F01M 11/12
(52) U.S. Cl. ..... 184/103.1; 184/6.23
(58) Field of Search ..... 184/6.23, 103.1

(56) References Cited

U.S. PATENT DOCUMENTS 2,460,814 A * 2/1949 Duerr Jr. ..... 418/90
3,502,186 A * 3/1970 Hewitt ..... 184/103.1
3,871,484 A * 3/1975 Thomas ..... 184/6.26
3,934,678 A * 1/1976 Jennings ..... 184/103.1

FOREIGN PATENT DOCUMENTS

JP 61-14796 5/1986
JP 63-34305 3/1988

* cited by examiner

*Primary Examiner*—Chong H. Kim
(74) *Attorney, Agent, or Firm*—Oblon, Spivak, McClelland, Maier & Neustadt, P.C.

(57) ABSTRACT

A lubrication system for a bearing of a machine. The system comprises an oil tank, and an oil supply pipe for supplying the lubricant oil from the oil tank to the bearing. The system further comprises an outlet pipe for guiding the lubricant oil from the bearing substantially vertically downward so that an outlet pipe oil level may be formed in the outlet pipe. The system further comprises an oil returning mother pipe for guiding the lubricant oil from the outlet pipe to the tank. The oil returning mother pipe includes a substantially horizontal part and a weir or a flow resistance disposed close to the tank so that substantially all portion of the substantially horizontal part may be maintained full of lubricant oil.

14 Claims, 8 Drawing Sheets

LUBRICATION SYSTEM AND ITS MODIFICATION METHOD

CROSS-REFERENCE TO RELATED APPLICATIONS

This application is based upon and claims the benefits of priority from the prior Japanese Patent Application No. 2002-023905, filed on Jan. 31, 2002; the entire contents of which are incorporated herein by reference.

BACKGROUND OF THE INVENTION

This invention is related generally to a lubrication system, more specifically to a lubrication system for bearings of a rotary machine such as a turbine power generator, and to a method of its modification.

In a conventional lubrication system for bearings of a rotary machine such as a turbine power generator, the lubricant oil supplied to the bearings returns to an oil tank through an oil returning mother pipe which is inclined downward in order to allow the oil to return to the tank smoothly and to prevent the oil from blowing out of the bearings. Then, a free surface of liquid oil is formed in the pipe, and the oil is collected in the tank, so that fire due to the oil blowout can be prevented. In addition, an air layer is formed above the free liquid oil surface due to the inclination of the pipe, and the air layer connects the turbine bearings and the oil tank. Therefor, the turbine bearings are kept under a negative pressure, because the tank is connected to an exhaust pump through an exhaust pipe and is kept under a negative pressure. Thus, the oil leakage from the bearings are prevented.

Now, a conventional lubrication system for bearings of a turbine generator of an electric power plant is discussed referring to FIGS. 1A and 1B. Referring to FIG. 1A, a typical turbine generator 1 has a plurality of bearings 3, although only one bearing 3 is shown in FIG. 1A for illustrative simplicity. Lubricant oil is supplied to the bearings 3 from an oil tank 2 through an oil supply pump 13 and an oil supply pipe 12. The lubricant oil returns to the oil tank 2 via an oil returning pipe 4 by gravity. The oil returning pipe 4 surrounds the oil supply pipe 12 forming a co-axial double pipe structure.

The oil returning pipe 4 includes outlet pipes 20 extending vertically downward from the bearings 3, and an oil returning mother pipe 21 for collecting oil from the outlet pipes 20 and delivering the oil to the oil tank 2. The oil returning mother pipe 21 is inclined downward to the oil tank 2.

As shown in FIG. 1A, a free liquid surface 22 is formed in the oil returning mother pipe 21 of the conventional lubrication system for the bearings of the turbine generator of the power plant. Thus, outflow of the oil from the bearings which are positioned above the oil liquid level is prevented.

In addition, the air space in the turbine bearings 3 and the air space in the oil tank 2 is communicated through the air above the free liquid surface 22 in the oil returning mother pipe 21, and the oil tank 2 is in a vacuum condition due to an exhaust pump 42 and an exhaust pipe 44 attached to the oil tank 2. Thus, the turbine bearings 3 are maintained in a vacuum condition, and outflow of the oil from the bearings are prevented more effectively.

However, in the conventional oil returning mother pipe 21 described above, the free liquid surface 22 is formed, and the upper part of the inner surface of the oil returning mother pipe 21 may rust. Thus, the oil returning mother pipe 21 deteriorates in years, and the rust gets mixed into the turbine oil, which would adversely affect the plant operation. Although stainless steel may be used for the oil returning mother pipes 21 to suppress rust in some cases, stainless steel is more difficult to be worked and more expensive compared to carbon steel. In addition, the conventional oil returning mother pipe 21 must have inclination toward the tank and must not have a reverse inclination to form the free liquid surface 22, which has resulted in strict restriction to the plant layout design.

Some efforts have been made for maintaining the inner surface of the oil returning mother pipe as disclosed in Japanese Utility Model Application Disclosure Jitsu-kai-Sho 63-34305 and in Japanese Utility Model Publication Jitsu-ko-Sho 61-14796, the disclosures of which are hereby incorporated by reference in their entirety. However, those known systems have dry areas in the upper part of the oil returning mother pipes which would result in the rust.

BRIEF SUMMARY OF THE INVENTION

Accordingly, it is an object of the present invention to provide a lubrication system for a bearing of a rotary machine. The lubrication system is improved in preventing or suppressing rust in the oil returning mother pipe and also improved in less restricted pipe inclination requirement. It is another object of the present invention to provide a method for modifying an existing lubrication system and reconstructing such a new lubrication system for a bearing of a rotary machine.

There has been provided, in accordance with an aspect of the present invention, a lubrication system for a bearing of a machine, the lubrication system comprising: an oil tank for storing lubricant oil so that a tank oil level may be formed in the tank, the tank oil level positioned below the bearing: an oil supply pipe for supplying the lubricant oil from the oil tank to the bearing; an outlet pipe for guiding the lubricant oil from the bearing substantially vertically downward so that an outlet pipe oil level may be formed in the outlet pipe; an oil returning mother pipe for guiding the lubricant oil from the outlet pipe to the tank, the oil returning mother pipe including a substantially horizontal part and a weir disposed close to the tank so that substantially all portion of the substantially horizontal part may be maintained full of lubricant oil below the weir; and a vent pipe for communicating the outlet pipe above the outlet pipe oil level and the tank above the tank oil level.

There has also been provided, in accordance with another aspect of the present invention, a lubrication system for a bearing of a machine, the lubrication system comprising: an oil tank for storing lubricant oil so that a tank oil level may be formed in the tank, the tank oil level positioned below the bearing: an oil supply pipe for supplying the lubricant oil from the oil tank to the bearing; an outlet pipe for guiding the lubricant oil from the bearing substantially vertically downward so that an outlet pipe oil level may be formed in the outlet pipe; an oil returning mother pipe for guiding the lubricant oil from the outlet pipe to the tank, the oil returning mother pipe including a substantially horizontal part and a flow resistance disposed close to the tank so that substantially all portion of the substantially horizontal part may be maintained full of lubricant oil; and a vent pipe for communicating the outlet pipe above the outlet pipe oil level and the tank above the tank oil level.

There has also been provided, in accordance with yet another aspect of the present invention, a method for modifying an existing lubrication system and reconstructing a new lubrication system for a bearing of a machine, the existing lubrication system comprising: an oil tank for storing lubricant oil so that a tank oil level may be formed in the tank, the tank oil level positioned below the bearing: an oil supply pipe for supplying the lubricant oil from the oil tank to the bearing; an outlet pipe for guiding the lubricant oil from the bearing substantially vertically downward so that an outlet pipe oil level may be formed in the outlet pipe; an oil returning mother pipe for guiding the lubricant oil from the outlet pipe to the tank, the oil returning mother pipe covering part of the oil supply pipe; and a vent pipe for communicating the outlet pipe above the outlet pipe oil level and the tank above the tank oil level; the method comprising: separating the existing oil returning mother pipe from the existing outlet pipe and the existing tank, while the existing oil returning mother pipe is maintained to cover part of the oil supply pipe; and disposing a new oil returning mother pipe outside of the existing oil returning mother pipe and connecting the new oil returning mother pipe to the existing outlet pipe and the existing tank, wherein the new oil returning mother pipe including a substantially horizontal part and a weir or a flow resistance disposed close to the tank so that substantially all portion of the substantially horizontal part may be maintained full of lubricant oil.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Figure 1A:
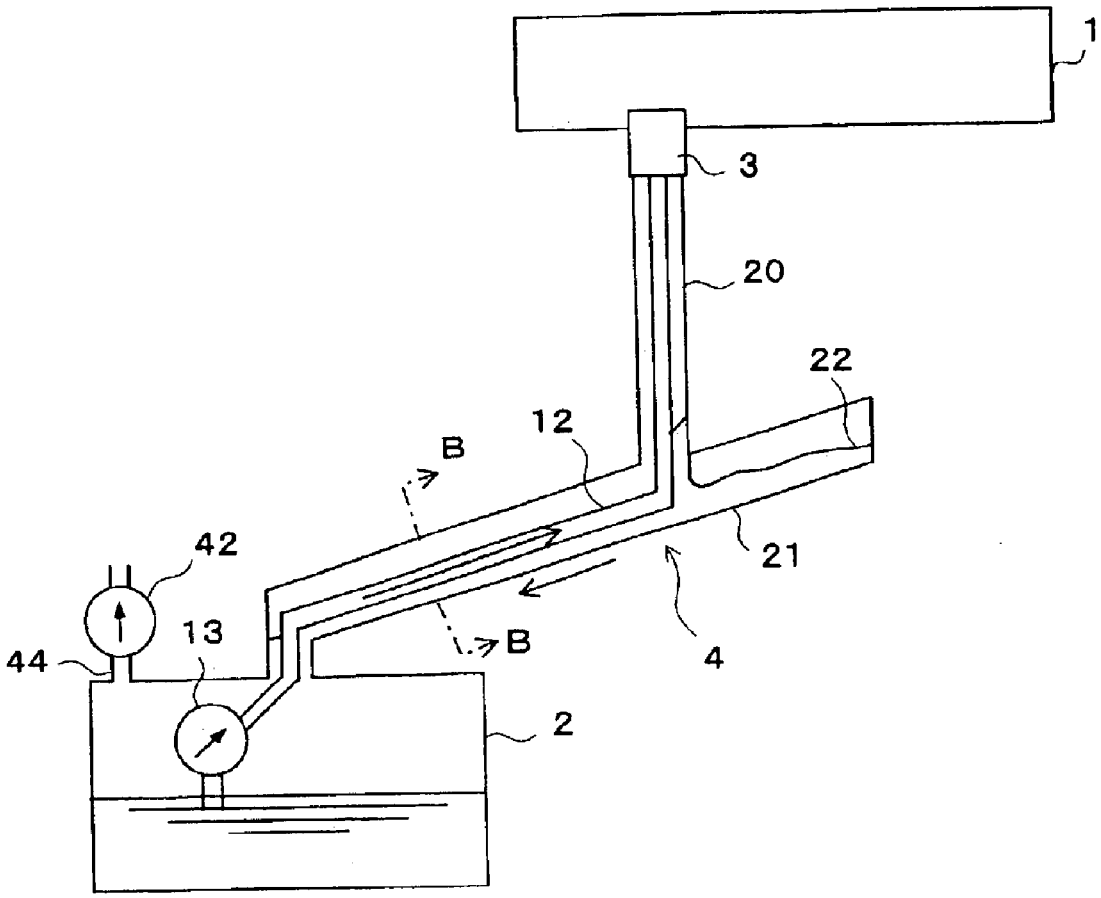
FIG. 1A is a schematic elevational cross-section view of a conventional lubrication system.

In the following description and also in the above description of background of the invention, like reference numerals represent like elements, and redundant description may be omitted.

First Embodiment

A first embodiment of a lubrication system according to the present invention is now described with reference to FIG. 2. The turbine generator 1 has a plurality of bearings 3, three of which are shown in FIG. 3. Lubricant oil in the oil tank 2 is supplied to the bearings 3 via the oil supply pump 13 and the oil supply pipe 12. The oil supplied to the bearings 3 returns to the oil tank 2 via an oil returning pipe 34 by gravity.

The oil supply pipe 12 is disposed in the returning pipe 34 which functions as a so-called wet guard of the oil supply pipe 12. The oil supply pump 13 is in the oil tank 2 in this embodiment, but it can be alternatively disposed outside of the oil tank 2.

The oil returning pipe 34 has a plurality of outlet pipes 20 and an oil returning mother pipe 31. Each of the outlet pipes 20 is connected to one of the bearings 3, and extends vertically downward to the oil returning mother pipe 31, which collects the oil from the outlet pipes 20 and guides it to the oil tank 2.

The upper parts of the outlet pipes 20 and the top of the oil tank 2 are connected by vent pipes 5. The connection points 37 of the outlet pipes 20 and the vent pipes 5 are slightly below the bearings 3. Thus, the ends of the vent pipes 5 open to the air spaces above the liquid levels 36 in the outlet pipes 20, and the bearings 3 are evacuated through the vent pipes 5, because the oil tank 2 is evacuated by the exhaust pump 42. Although the vent pipes 5 shown in FIG. 2 are separated, the vent pipes may be alternatively merged into a single mother vent pipe near the oil tank 2.

The oil returning mother pipe 31 has a weir 6 near the oil tank 2, and most rest part of the oil returning mother pipe 31 is horizontal. The weir 6 is formed with a rising portion of a thicker pipe. Since the oil overflows the weir 6 before flowing down to the tank 2, an oil level is formed at the weir 6, and the oil returning mother pipe 31 is filled with oil. Oil levels 36 are formed in the outlet pipes 20 at about the same height of the weir 6 which is lower than the height of the connection points 37 of the outlet pipes 20 and the vent pipes 5.

Since the oil returning mother pipe 31 is filled with oil, rust there can be prevented or suppressed. Then, the oil returning mother pipe 31 can be formed by carbon steel which is easier to be worked and less expensive than stainless steel. In addition, lay out design of the oil returning mother pipe 31 may become more flexible because inclination is not needed.

Since the outlet pipes 20 are vertical, oil flows down in a liquid film along the whole inner surface of the outlet pipes 20 above the liquid levels 36 in the outlet pipes 20. Therefore, no rust would be generated in the outlet pipes 20.

Figure 2:
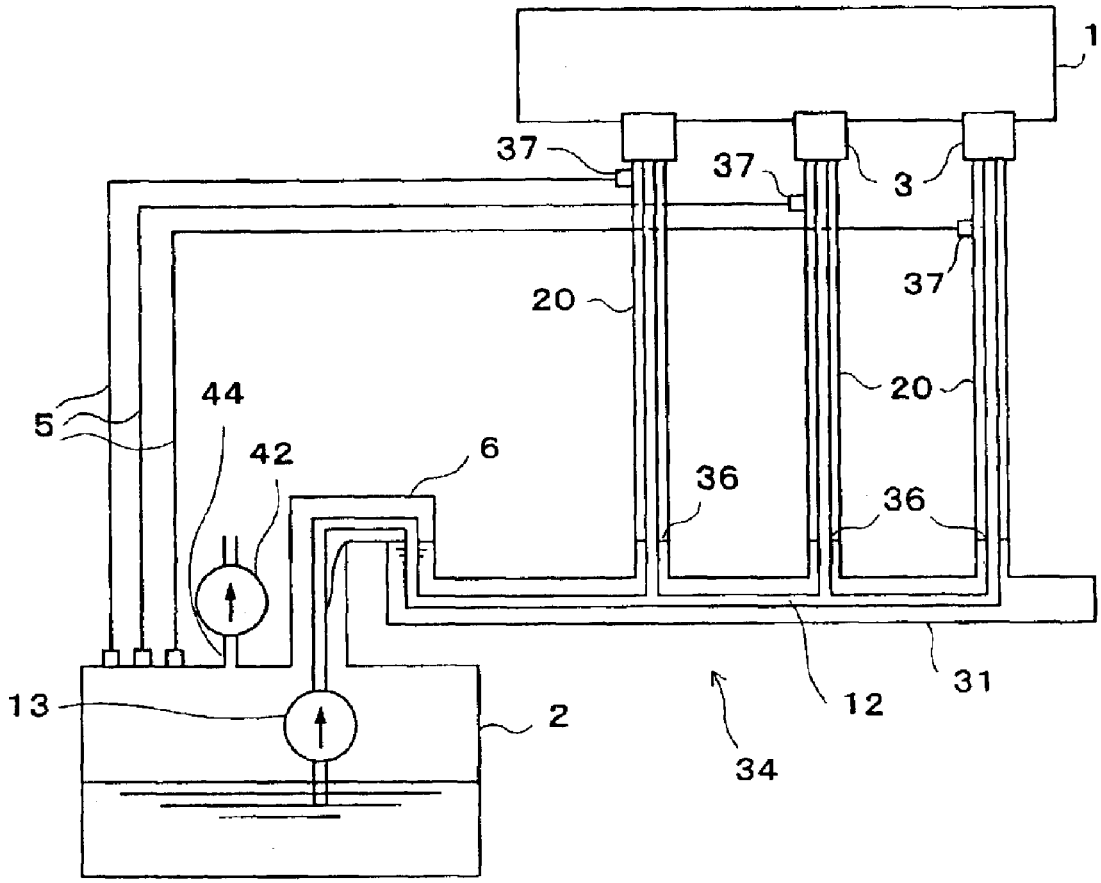
FIG. 2 is a schematic elevational cross-section view of a first embodiment of a lubrication system according to the present invention.
Figure 3:
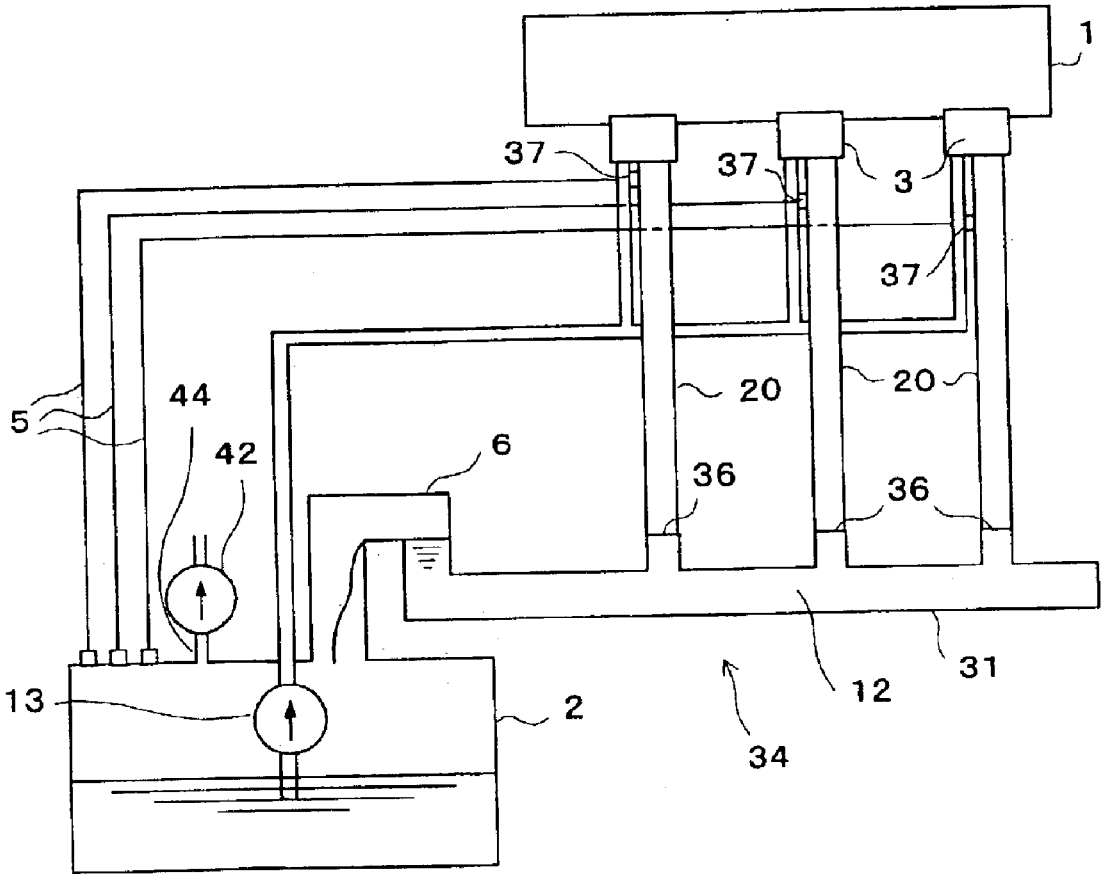
FIG. 3 is a schematic elevational cross-section view of a second embodiment of a lubrication system according to the present invention.

Although three bearings 3 are shown in FIG. 2, there may be alternatively a single bearing 3 in the lubricant system according to the present invention. In such a case, the single outlet pipe 20 may be connected to the oil returning mother pipe 31, and the outlet pipe 20 and the oil returning mother pipe 31 can be formed in a single continuous bent pipe (not shown).

Second Embodiment

A second embodiment of a lubrication system according to the present invention is now described with reference to FIG. 3. This embodiment is similar to the first embodiment except that an oil supply pipe 12 is disposed outside of the oil returning pipe 34 instead of outside of it. The oil supply pipe 12 guides the oil from the tank 2 via the oil supply pump 13 to the bearings 3. This embodiment is easier to be constructed because the oil supply pipe 12 and the oil returning pipe 34 are separated.

Third Embodiment

Figure 1B:
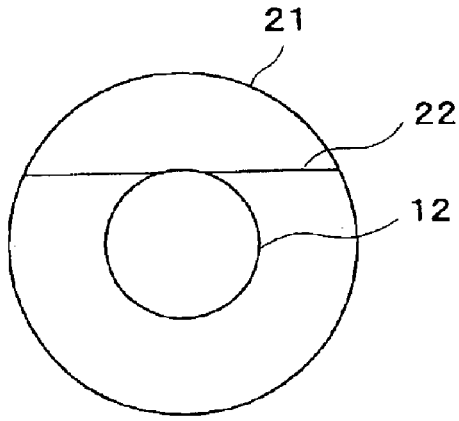
FIG. 1B is a cross-section view along Line B—B shown in FIG. 1A.
Figure 4:
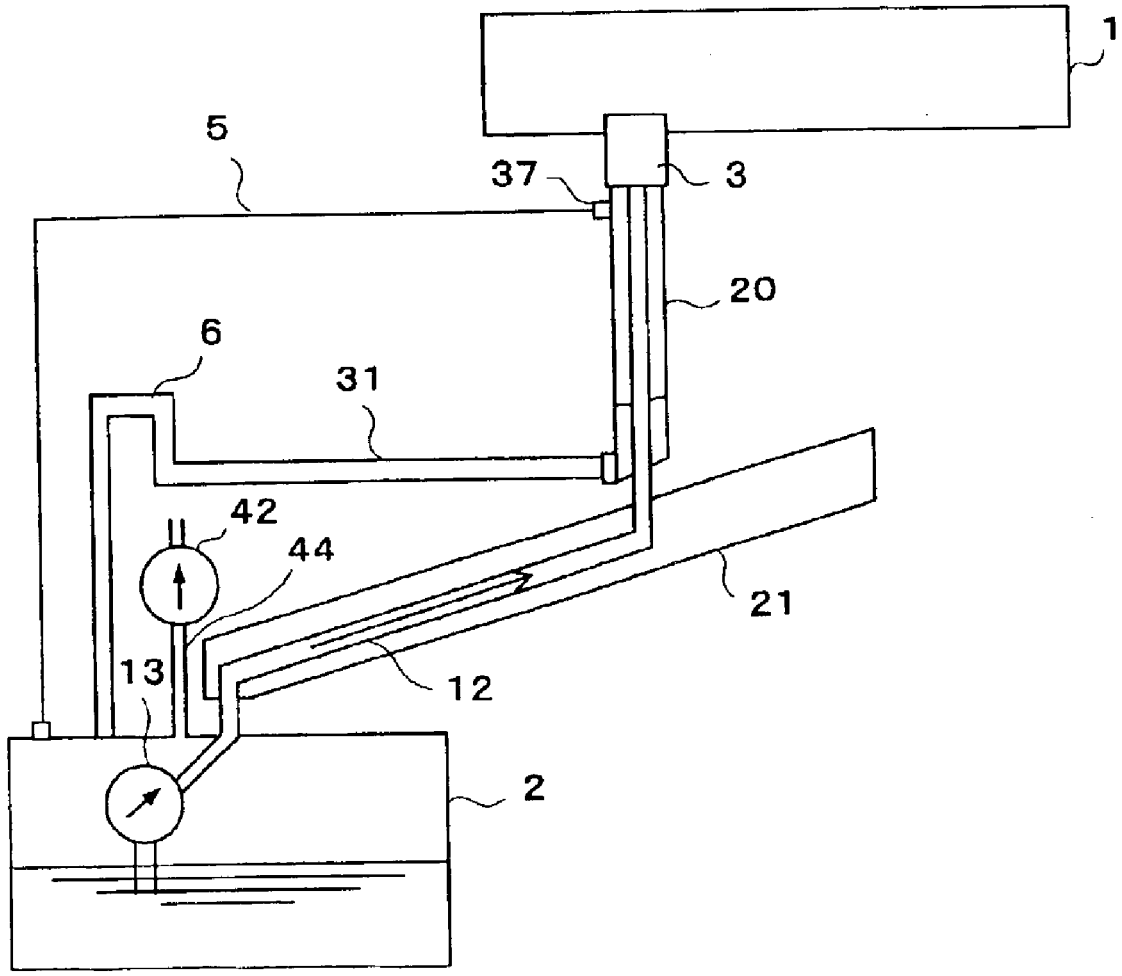
FIG. 4 is a schematic elevational cross-section view of a third embodiment of a lubrication system according to the present invention.

A third embodiment of a lubrication system according to the present invention is now described with reference to FIG. 4. This embodiment is an example of a modification of an existing lubrication system into a new lubrication system according to the present invention. An existing lubrication system shown in FIG. 1 can be easily modified to a new lubrication system shown in FIG. 4 as follows:

The existing oil returning mother pipe 21 is separated from the existing outlet pipes 20 and from the existing oil tank 2, while the existing oil returning mother pipe 21 is maintained to cover lower part of the oil supply pipe 12. Then the bottom ends of the existing outlet pipes 20 are connected to the oil tank 2 via a new oil returning mother pipe 31 which is disposed outside of the existing oil returning mother pipe 21. The new oil returning mother pipe 31 has a weir 6 and the rest part of the new oil returning mother pipe 31 is substantially horizontal as in the first and second embodiments shown in FIGS. 2 and 3, respectively.

According to this embodiment, substantially all portion of the horizontal part of the new oil returning mother pipe 31 is filled with the lubricant oil below the weir 6 as in the first and the second embodiments. In addition, the old oil returning mother pipe 21 can be reused as a dry guard for protecting part of the oil supply pipe 12.

Fourth Embodiment

A fourth embodiment of a lubrication system according to the present invention is now described with reference to FIG. 5. This embodiment is similar to the first or second embodiments except that an orifice 8 is disposed as a flow resistance at the exit of the oil returning mother pipe 31 in place of the weir 6. The oil supply pipe 12 can be disposed either in the oil returning pipe 34 as in the first embodiment (FIG. 2) or outside of the oil returning pipe 34 as in the second embodiment (FIG. 3), although the oil supply pipe 12 is not shown in FIG. 5 for illustrative simplicity.

The oil returning mother pipe 31 is laid horizontally. While oil is supplied to the bearings 3 via the oil supply pipe 12 (FIGS. 2 and 3), the oil returns to the oil tanks through the oil returning pipe 34. Since the orifice 8 is positioned at the exit of the oil returning mother pipe 31 of the oil returning pipe 34, the oil flow back to the oil tank 2 is restricted, and liquid oil levels 36*a* or 36*b* are formed in the outlet pipes 20 below the connection points 37 of the vent pipes 5. Thus, the whole oil returning mother pipe 31 is filled with oil, and rust in the oil returning mother pipe 31 can be prevented or suppressed.

Figure 5:
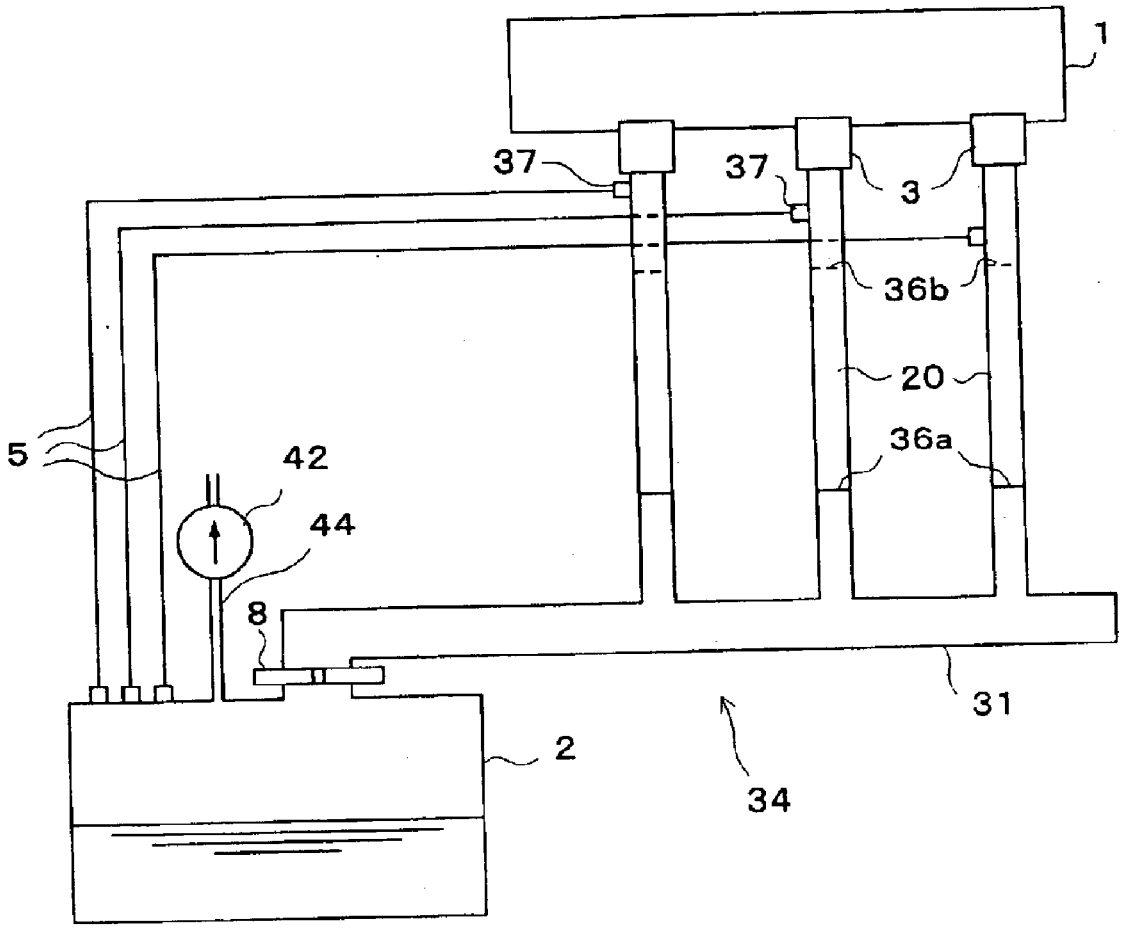
FIG. 5 is a schematic elevational cross-section view of a fourth embodiment of a lubrication system according to the present invention.

Now the height of the outlet pipes 20 is discussed referring to FIG. 5. The oil temperature is higher and thus the oil viscosity is lower when the rotary machine such as a turbine generator is in operation compared to those when the machine is out of operation. Therefore, the pressure drop at the orifice 8 is lower when the machine is in operation. Then, the liquid oil levels 36*a* in the outlet pipes 20 when the machine is in operation are lower than the liquid oil levels 36*b* in the outlet pipes 20 when the machine is out of operation. The outlet pipes 20 are designed so that the liquid oil levels 36*a* and 36*b* in the outlet pipes 20 may be maintained below the connection points 37 of outlet pipes 20 and vent pipes 5 and above the bottom ends of the outlet pipes 2 or the top portion of the oil returning mother pipe 31, considering the oil temperature change. Thus, the whole oil returning mother pipe 31 can be maintained full of oil.

Fifth Embodiment

A fifth embodiment of a lubrication system according to the present invention is now described with reference to FIG. 6. This embodiment is similar to the fourth embodiment except that a narrow pipe 7 is disposed as a flow resistance at the exit of the oil returning mother pipe 31 in place of the orifice 8. The function of the narrow pipe 7 of this embodiment is similar to that of the orifice 8 of the fourth embodiment. Then, according to the fifth embodiment, substantially all part of the oil returning mother pipe 31 can be maintained full of oil as in the fourth embodiment.

Sixth Embodiment

Figure 7:
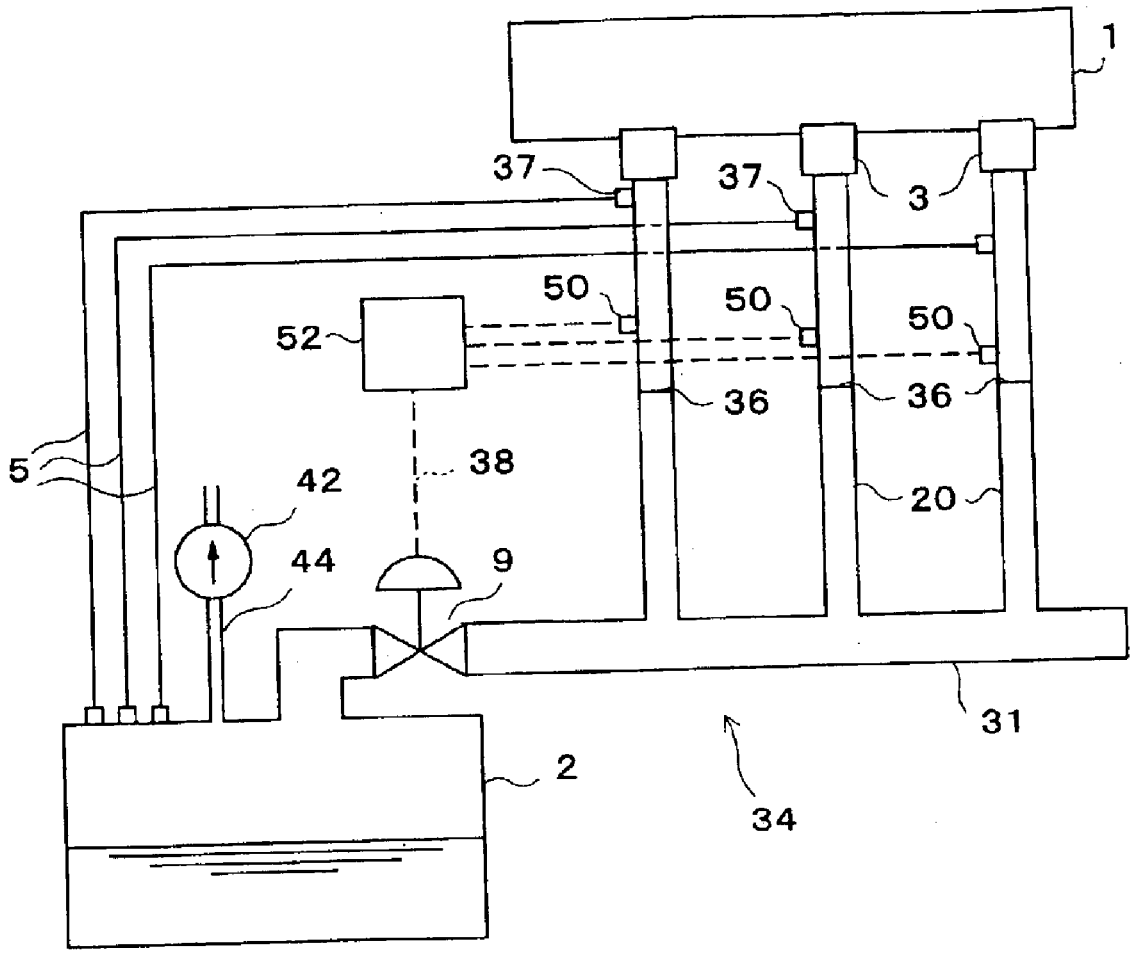
FIG. 7 is a schematic elevational cross-section view of a sixth embodiment of a lubrication system according to the present invention.

A sixth embodiment of a lubrication system according to the present invention is now described with reference to FIG. 7. This embodiment is similar to the fourth or fifth embodiments except that a control valve 9 is disposed as an adjustable flow resistance at the exit of the oil returning mother pipe 31 in place of the orifice 8 or the narrow pipe 7. In addition, oil level detectors 50 are attached to the outlet pipes 20. The opening of the control valve 9 is controlled by a level control signal 38 which is sent from a controller 52 based on the oil levels 36 in the outlet pipes 20 detected by the oil level detectors 50.

The control valve 9 is controlled so that the oil levels 36 in the outlet pipes 20 may be maintained below the connection point 37 of outlet pipes 20 and the vent pipes 5, and above the lower ends of the outlet pipes 20. According to this embodiment, substantially all part of the oil returning mother pipe 31 can be maintained full of oil. In addition, the oil levels 36 in the outlet pipes 20 can be maintained within a relatively short range, and the heights of the outlet pipes 20 can be shortened.

Seventh Embodiment

Figure 8:
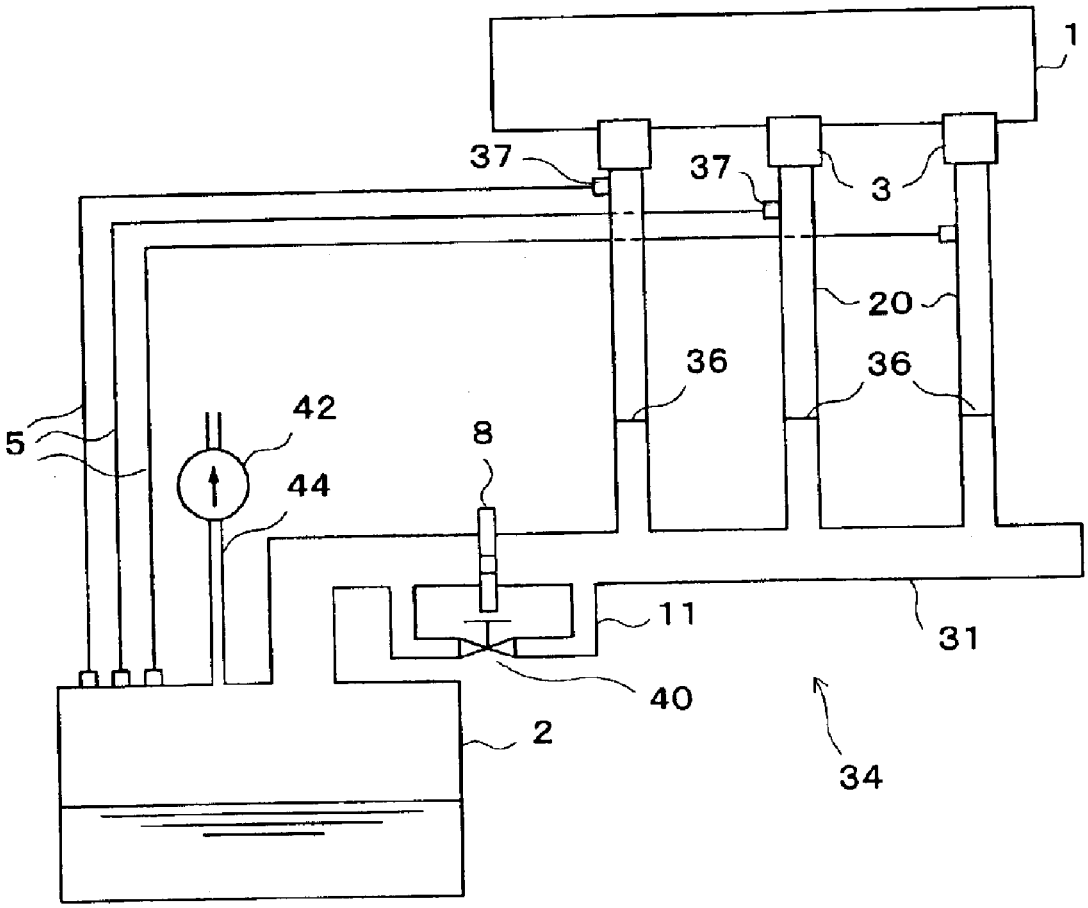
FIG. 8 is a schematic elevational cross-section view of a seventh embodiment of a lubrication system according to the present invention.

A seventh embodiment of a lubrication system according to the present invention is now described with reference to FIG. 8. This embodiment is similar to the fourth embodiment except that a bypass pipe 11 with a bypass control valve 40 is added for allowing bypassing part of the flow through the orifice 8.

Total flow resistance of the combination of the orifice 8 and the bypass pipe 11 with the bypass control valve 40 can be adjusted by the bypass control valve 40. When the bypass control valve 40 is opened wider, for example, the total flow resistance of the combination of the orifice 8 and the bypass pipe 11 becomes smaller. Thus, the oil level 36 in the outlet pipe 20 can be controlled by the adjustment of the bypass control valve 40.

According to this embodiment, substantially all part of the oil returning mother pipe 31 can be maintained full of oil. In addition, the oil levels 36 in the outlet pipes 20 can be maintained within a relatively short range, and the heights of the outlet pipes 20 can be shortened, as in the sixth embodiment discussed above.

Furthermore, the oil level detectors 50 (FIG. 7) may be optionally attached to the outlet pipes 20 and the opening of the bypass valve 40 may be controlled based on the oil levels 36 in the outlet pipes 20 detected by the oil level detectors 50, as in the sixth embodiment.

Figure 6:
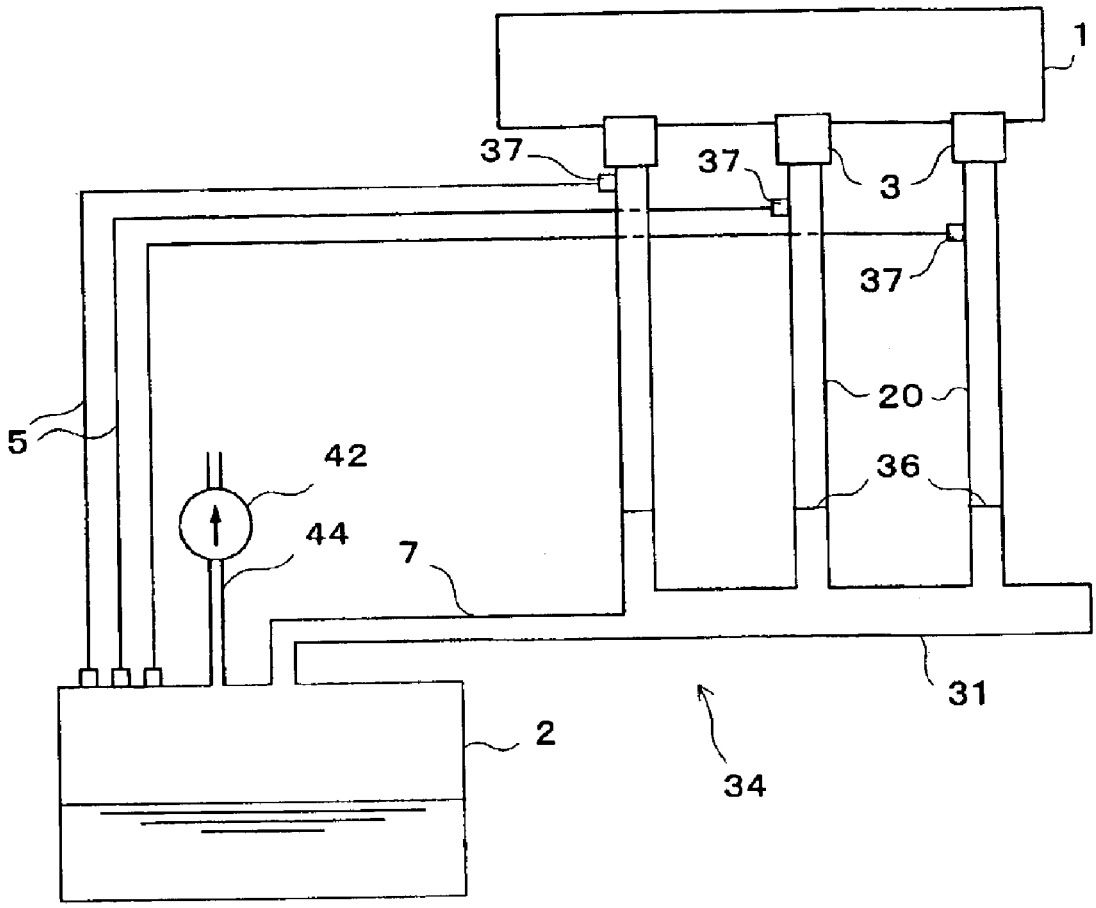
FIG. 6 is a schematic elevational cross-section view of a fifth embodiment of a lubrication system according to the present invention.

Furthermore, the orifice 8 in this embodiment can be replaced by the narrow pipe 7 (FIG. 6).

Other Embodiments

Various combinations of the features of the embodiments described above may be possible in addition to those specifically cited above. For example, the feature of the third embodiment (FIG. 4) that the existing oil returning mother pipe 21 is reused as a dry guard for protecting lower part of the oil supply pipe 12 can be applied to any of the fourth through the seventh embodiments as well as to the first or the second embodiments.

Numerous modifications and variations of the present invention are possible in light of the above teachings. It is, therefore, to be understood that, within the scope of the appended claims, the present invention can be practiced in a manner other than as specifically described herein.

What is claimed is:

1. A lubrication system for a bearing of a machine, the lubrication system comprising:

an oil tank for storing lubricant oil so that a tank oil level may be formed in the tank, the tank oil level positioned below the bearing;

an oil supply pipe for supplying the lubricant oil from the oil tank to the bearing;

an outlet pipe for guiding the lubricant oil from the bearing substantially vertically downward so that an outlet pipe oil level may be formed in the outlet pipe;

an oil returning mother pipe for guiding the lubricant oil from the outlet pipe to the tank, the oil returning mother pipe including a substantially horizontal part and a weir disposed close to the tank so that substantially all portion of the substantially horizontal part may be maintained full of lubricant oil below the weir; and a vent pipe for communicating the outlet pipe above the outlet pipe oil level and the tank above the tank oil level.

2. The lubrication system according to claim 1, wherein at least part of the oil supply pipe is disposed in the oil returning mother pipe.

3. The lubrication system according to claim 1, wherein the oil supply pipe is disposed outside of the oil returning mother pipe.

4. The lubrication system according to claim 3, wherein part of the oil supply pipe is disposed in the outlet pipe, and at least part of the oil supply pipe outside of the outlet pipe is surrounded by a dry guard.

5. A lubrication system for a bearing of a machine, the lubrication system comprising:

an oil tank for storing lubricant oil so that a tank oil level may be formed in the tank, the tank oil level positioned below the bearing:

an oil supply pipe for supplying the lubricant oil from the oil tank to the bearing;

an outlet pipe for guiding the lubricant oil from the bearing substantially vertically downward so that an outlet pipe oil level may be formed in the outlet pipe;

an oil returning mother pipe for guiding the lubricant oil from the outlet pipe to the tank, the oil returning mother pipe including a substantially horizontal part and a flow resistance disposed close to the tank so that substantially all portion of the substantially horizontal part may be maintained full of lubricant oil; and a vent pipe for communicating the outlet pipe above the outlet pipe oil level and the tank above the tank oil level.

6. The lubrication system according to claim 5, wherein the flow resistance includes an orifice.

7. The lubrication system according to claim 5, wherein the flow resistance includes a narrow pipe which has a smaller cross section area than other part of the oil returning mother pipe.

8. The lubrication system according to claim 5, wherein:

the lubrication system further comprises a level detector for detecting the outlet pipe oil level; and the flow resistance includes a control valve which is so designed to control the outlet pipe oil level detected by the level detector may be maintained below connecting point of the vent pipe to the outlet pipe and above lower end of the outlet pipe.

9. The lubrication system according to claim 5, wherein the vent pipe is connected to the outlet pipe at a higher level than the outlet pipe oil level which is predicted during operation of the machine.

10. The lubrication system according to claim 5, further comprising a bypass pipe for bypassing the flow resistance.

11. The lubrication system according to claim 5, wherein at least part of the oil supply pipe is disposed in the oil returning mother pipe.

12. The lubrication system according to claim 5, wherein the oil supply pipe is disposed outside of the oil returning mother pipe.

13. The lubrication system according to claim 12, wherein part of the oil supply pipe is disposed in the outlet pipe, and at least part of the oil supply pipe outside of the outlet pipe is surrounded by a dry guard.

14. A method for modifying an existing lubrication system and reconstructing a new lubrication system for a bearing of a machine, the existing lubrication system comprising:

an oil tank for storing lubricant oil so that a tank oil level may be formed in the tank, the tank oil level positioned below the bearing;

an oil supply pipe for supplying the lubricant oil from the oil tank to the bearing;

an outlet pipe for guiding the lubricant oil from the bearing substantially vertically downward so that an outlet pipe oil level may be formed in the outlet pipe;

an oil returning mother pipe for guiding the lubricant oil from the outlet pipe to the tank, the oil returning mother pipe covering part of the oil supply pipe; and a vent pipe for communicating the outlet pipe above the outlet pipe oil level and the tank above the tank oil level;

the method comprising:

separating the existing oil returning mother pipe from the existing outlet pipe and the existing tank, while the existing oil returning mother pipe is maintained to cover part of the oil supply pipe; and disposing a new oil returning mother pipe outside of the existing oil returning mother pipe and connecting the new oil returning mother pipe to the existing outlet pipe and the existing tank, wherein the new oil returning mother pipe including a substantially horizontal part and a weir or a flow resistance disposed close to the tank so that substantially all portion of the substantially horizontal part may be maintained full of lubricant oil.

* * * * *